US007338116B1

(12) United States Patent
Lin et al.

(10) Patent No.: US 7,338,116 B1
(45) Date of Patent: Mar. 4, 2008

(54) FOLDING CHAIR

(76) Inventors: Mei Chuen Lin, 9F, No. 275-1, Yuan-Hua Road, Chung-Li City, Taoyuan Hsien (TW); Tzu Mei Wang, 9F, No. 275-1, Yuan-Hua Road, Chung-Li City, Taoyuan Hsien (TW)

( * ) Notice: Subject to any disclaimer, the term of this patent is extended or adjusted under 35 U.S.C. 154(b) by 0 days.

(21) Appl. No.: 11/567,845

(22) Filed: Dec. 7, 2006

(51) Int. Cl.
*A47C 4/00* (2006.01)

(52) U.S. Cl. ..... 297/46; 297/55; 297/56; 297/452.24; 297/452.14

(58) Field of Classification Search ..... 297/16.1, 297/46, 55, 56, 452.22, 452.24, 452.26, 452.29, 297/452.31, 452.32, 452.35, 452.36, 452.46, 297/452.14, 452.48, 452.55, 452.57, 463.1
See application file for complete search history.

(56) References Cited

U.S. PATENT DOCUMENTS

| | | | | |
|---|---|---|---|---|
| 719,908 | A * | 2/1903 | Truesdell | 297/56 |
| 1,423,594 | A * | 7/1922 | Barrows | 297/56 |
| 1,729,488 | A * | 9/1929 | Rastetter | 297/55 |
| 2,574,387 | A * | 11/1951 | Guthmann | 297/56 |
| 2,973,031 | A * | 2/1961 | Cramer, Jr. | 297/383 |
| 4,186,964 | A * | 2/1980 | Marrujo et al. | 297/411.45 |
| 4,331,360 | A * | 5/1982 | Roudybush et al. | 297/411.45 |
| 4,459,139 | A * | 7/1984 | vonReis et al. | 96/6 |
| 4,566,735 | A * | 1/1986 | Frobose | 297/452.46 |
| 6,612,654 | B2 * | 9/2003 | Laws et al. | 297/440.11 |

* cited by examiner

*Primary Examiner*—Laurie K. Cranmer
(74) *Attorney, Agent, or Firm*—Rabin & Berdo, P.C.

(57) ABSTRACT

A folding chair includes front and back legs, a cushion frame, a cushion embedded in the cushion frame and has a hard board having air vents, a sound absorbing foam, and a back cushion connected with the inner edge of the front leg and includes a second hard board. The hard boards have curved surfaces form fitting with the human body. A securing hook has a bent hook to clasp with the cushion frame. An inserting section can make the cushion and a support block to be connecting together. The curved surfaces of the cushion and the back cushion are form fitting with the human body, and the sound absorbing foam can reduce the sound sent out from the air vents when sitting. When a child's center of gravity on the chair is shifted to the back of the cushion, the cushion does not tilt backwards.

9 Claims, 8 Drawing Sheets

FOLDING CHAIR

BACKGROUND OF THE INVENTION

1. Field of the Invention

The present invention relates to a folding chair, and especially to a chair in which adults and children can both comfortably sit on, and of having a special sunken concave design beneath the back cushion and a circular sunken curve design below the cushion for being form-fitting with the human body. The chair further has added air permeability and sound absorbing capabilities.

2. The Prior Arts

FIG. 7 shows a conventional folding chair, in which the main body is made of steel bars. The conventional folding chair includes a cushion A, a back cushion B, a plurality of front legs C and back legs D, of which can permit the chair to be folded and unfolded.

This kind of chair is commonly used in offices, meeting rooms, or community centers. Although the overall structure of the chair is simple and rather light, it remains to have quite a number of shortcomings during normal usage. For example, the back cushion B and the cushion A, being made of steel board or plastic board, are typically designed as having a flat surface. The back cushion does not have any curvature, and at most, the cushion may only be wrapped in a layer of covering. To sit on this kind of chair, people will feel cold to the touch when at the first instant. However, after a longer period of sitting, the buttocks and back will experience ache and stiffness. On the other hand, when a child having a smaller frame is sitting on the chair, the cushion will frequently tilt backwards to easily result in the buttocks of the child to be sliding out from the hollow section in the back of the cushion. Furthermore, this type of chair is fairly bland for use in formal occasions.

So in order to improve over the disadvantages of the conventional chair, some individuals have designed using the folding chair as the main structural focus, in which the back cushion F and the cushion E are wrapped in a leather cushion (as illustrated in FIG. 8). But it seems evident that although people sitting on this kind of folding chair would not feel cold at first, but after a long period of sitting, the person sitting on the chair will feel discomfort and must lean on the back cushion F with his back by force, so that the problem of the aching back and buttock is not solved. The reason for the above is that the cushion E and the back cushion F of this kind of chair are made of hard board as the substrate on which a layer of spongy cushion having a flat surface is formed. When first sitting on the spongy cushion, a person will experience a sinked-in feeling. But after sitting for a long time, because of the flatness of the surface of the cushion, the shape of the spongy cushion will be distorted according to the sitting posture; and thus it surely does not have any support capability when the sitting posture is not correct and is changed frequently. In addition, the problem of having the cushion E tilting backwards when the child is sitting is also not able to be resolved either.

SUMMARY OF THE INVENTION

The present invention proposes a design for a folding chair, especially in regards to designing a back cushion and a cushion having a different material and different shape from the conventional chair. The design intention is to make the chair to be form fitting according with the contours of people's backs so as to allow for the ability to lean on comfortably and naturally. In addition, a fixing structure is designed to prevent the cushion from tilting backwards when a child is sitting. Furthermore, because air will enter into the cushion from the outer leather layer, and a loud gas releasing sound will be sent out right when a person is sitting on the cushion, therefore, a sound absorbing structure is designed according to the present invention.

The basic structure of a folding chair includes a front leg in an arched shape, a cushion frame which is connected with the inner side of the front leg, and a back leg which is connected with the inner side of a front leg. The upper end of the back leg is formed with a support block for supporting the cushion frame disposed above.

A cushion includes a first hard board made of wood boards, whose center is formed to a sunken concave surface adapted to fit a person's buttock curvature. The sunken concave surface has a plurality of air vents distributed, and a sound absorbing foam layer is put on the concave surface and covering these air vents. A thick spongy cushion is attached to the first hard board; and the center of the thick spongy cushion is sunken along with the sunken curved surface of the first hard board. The spongy cushion and the first hard board are wrapped with a layer of leather. The finished cushion is embedded in the cushion frame, and the sound absorbing foam can reduce the sound which is sent out from the cushion at the moment of sitting.

A back cushion includes a second hard board made of layers of stacked plywood and a layer of composite plywood board. The middle section of the lower surface of these stacked plywoods is sunken toward the inside, which is able to adapt to a person's back when leaning on, and is forming a smooth curved surface between the two ends.

A securing hook is made of a flat iron piece; and one end of the securing hook is bent to form a declining bent hook, and which is clasped to the cushion frame; and the other end is a repeated bent surface which is formed with a inserting section and a disengaging section. The width of the inserting section, which has slight flexibility, is the same as the thickness of the support block; and the support block, having the entire thickness, can be pressed into the inserting section. The structure is used for preventing accidents due to the seat being tilting over when a child is sitting in the chair, so as to result in having the child's body sliding out from the spacing in between the back of the cushion and under the back cushion.

For the folding chair in the present invention, because the surface contour of the cushion and the back cushion is form fitting with the human body, a person sitting on the folding chair is thereby prevented from changing to an improper posture, also the spongy cushion having a substantial thickness would not be easily distorted, and as well as providing support for the person's body. Sitting on the chair for an extended period, a person's waist and back will not experience aches and pains. Furthermore, the sound absorbing foam can reduce the sound given out from the air vent during the instant of sitting. In the present invention, the leather, especially one having a deeper color tone, can add to the sense of overall quality of the chair. For the sake of safety considerations of the chair, the cushion frame and the back leg are connected together by means of the securing hooks. Even when the child's center of gravity on the chair is shifted to the back of the cushion, the cushion does not tilt backward. Thus this kind of chair can prevent the child's buttocks from coming out from the hollow section at the back of the cushion.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Reference will now be made in detail to embodiments of the present invention, examples of which are illustrated in the accompanying drawings. The present invention will be apparent to those skilled in the art by reading the following detailed description of a preferred embodiment and the skilled can operate it according to the reference.

Figure 1:
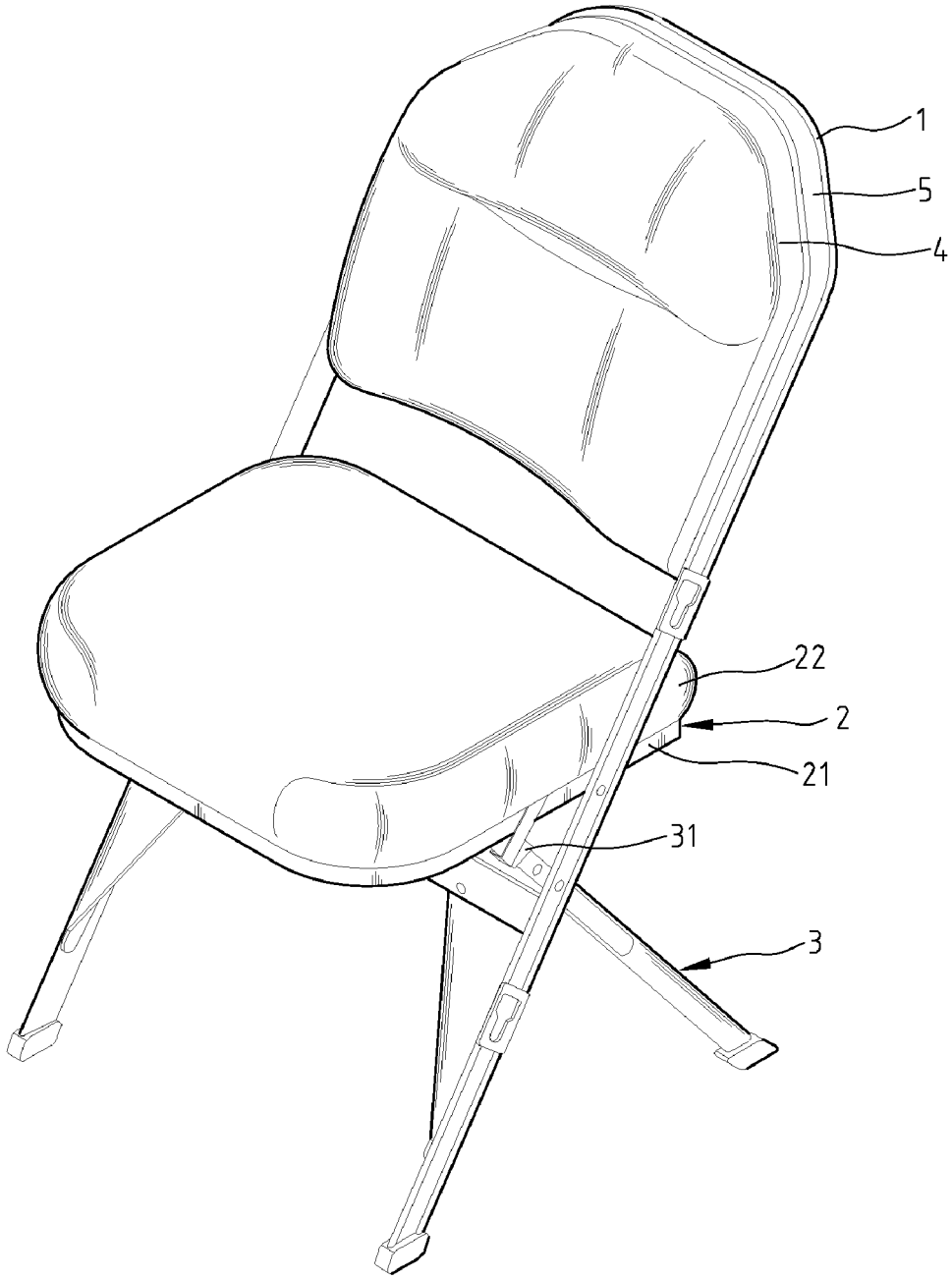
FIG. 1 is a perspective view showing a folding chair in accordance with the present invention.
Figure 6:
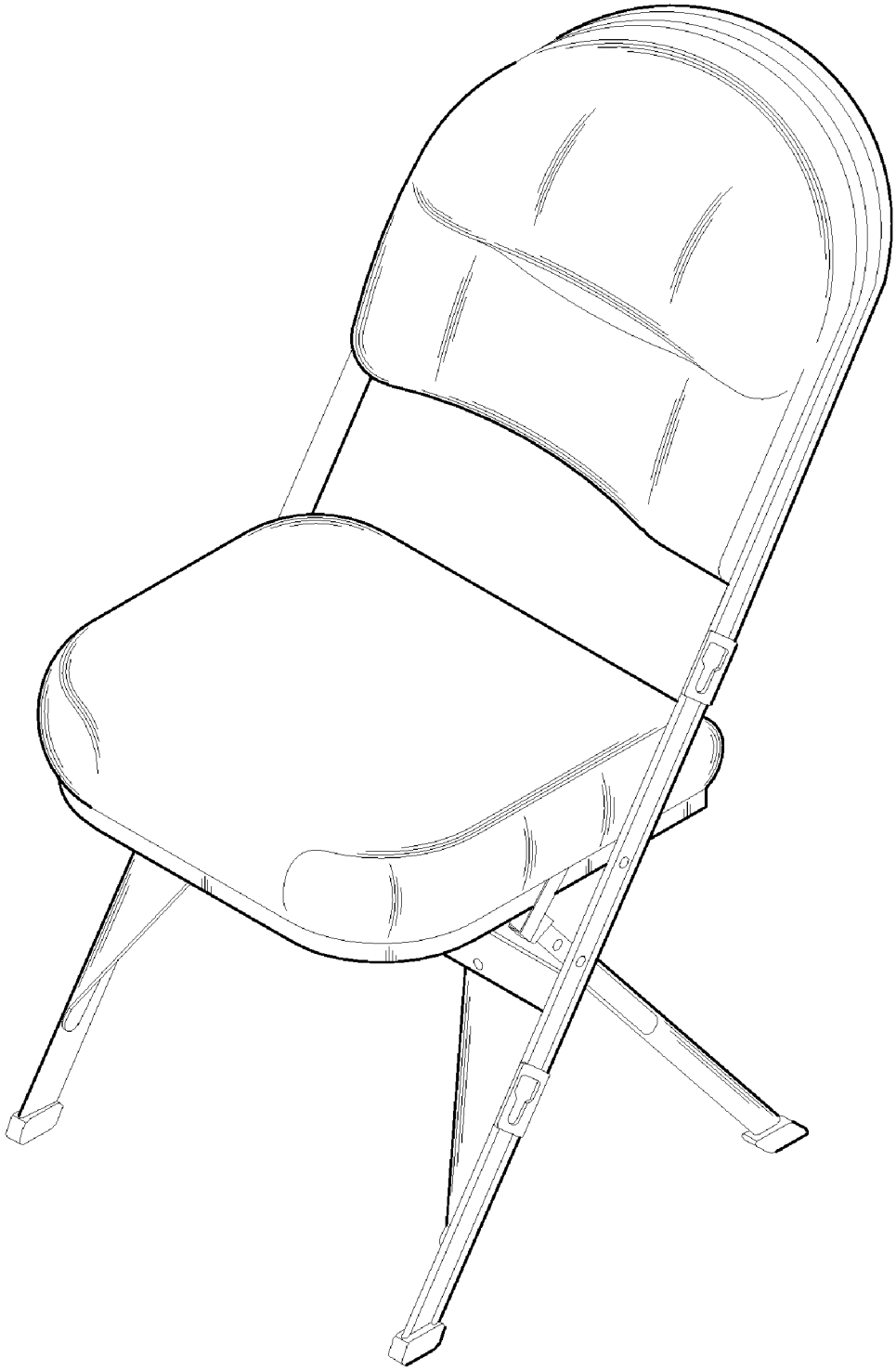
FIG. 6 is a perspective view showing a folding chair in accordance with another embodiment of the present invention.
Figure 7:
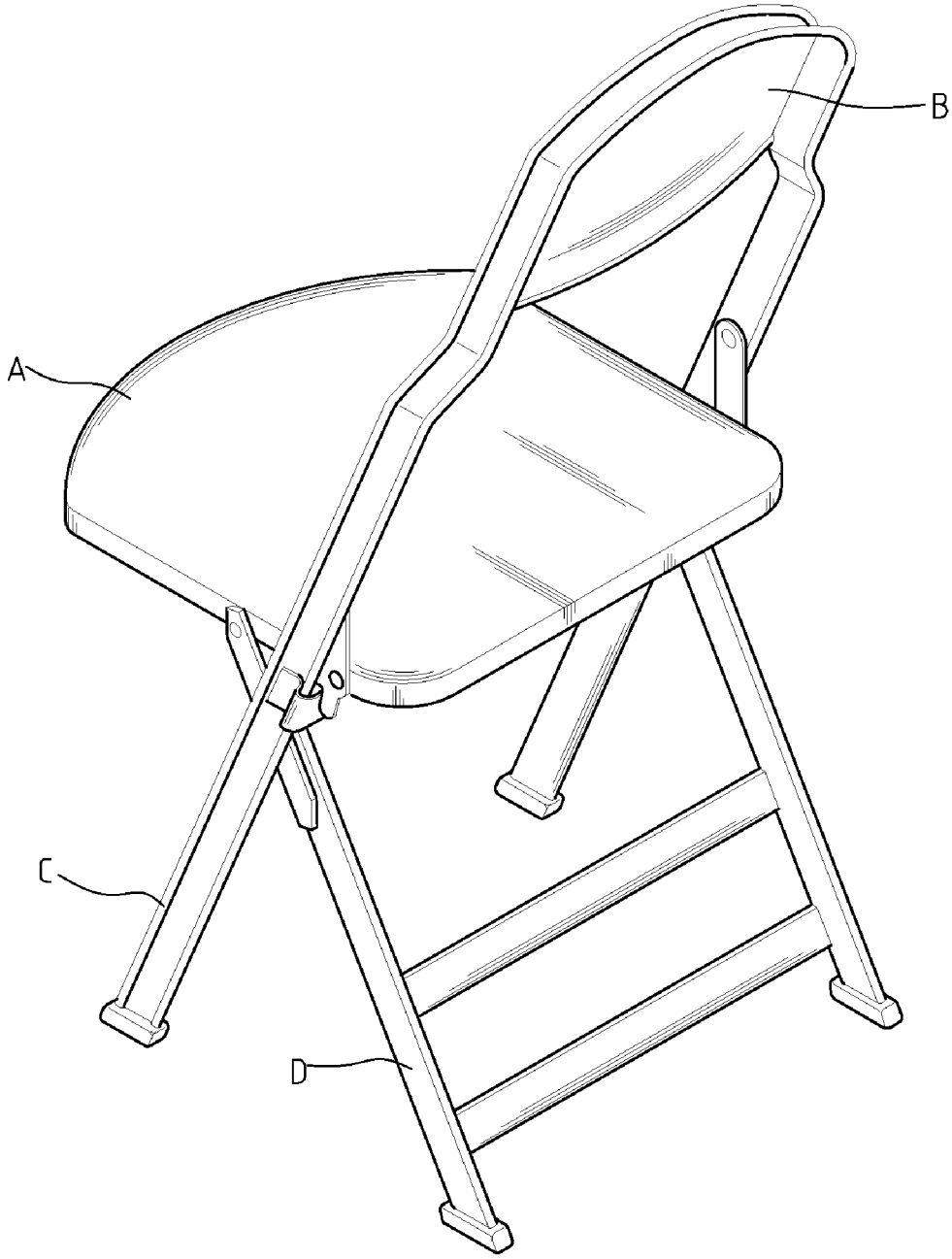
FIG. 7 (Prior Art)
FIG. 7 is a perspective view showing a conventional folding chair.
Figure 8:
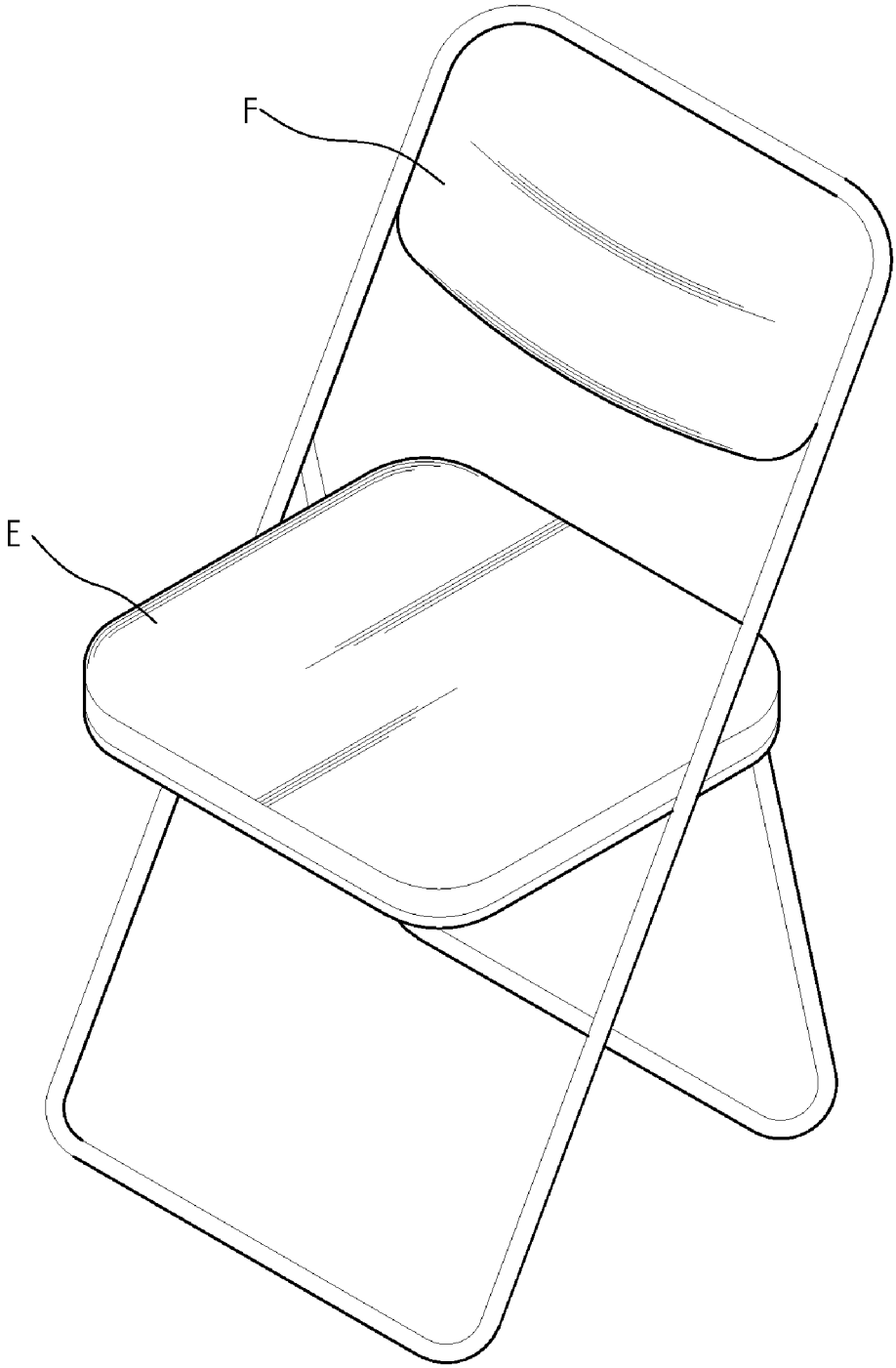
FIG. 8 (Prior Art)
FIG. 8 is a perspective view showing another conventional folding chair.

With reference to FIG. 1 showing a perspective view of the present invention, a folding chair includes a front leg 1 in an arched shape and with a symmetric turn surface, a cushion section 2 connected with the inner side of the front leg 1, and the cushion section 2 including a cushion frame 21 and is connecting with a cushion 22, and a back leg 3 connected with the inner side of the front leg 1. The top end of the back leg 3 is formed with a support block 31 to support the upper cushion section 2. The arched section of the front leg 1 is formed with a back cushion 4. The front leg 1 and the back cushion 2 can be designed to have an arc edge (see FIG. 6).

Figure 2:
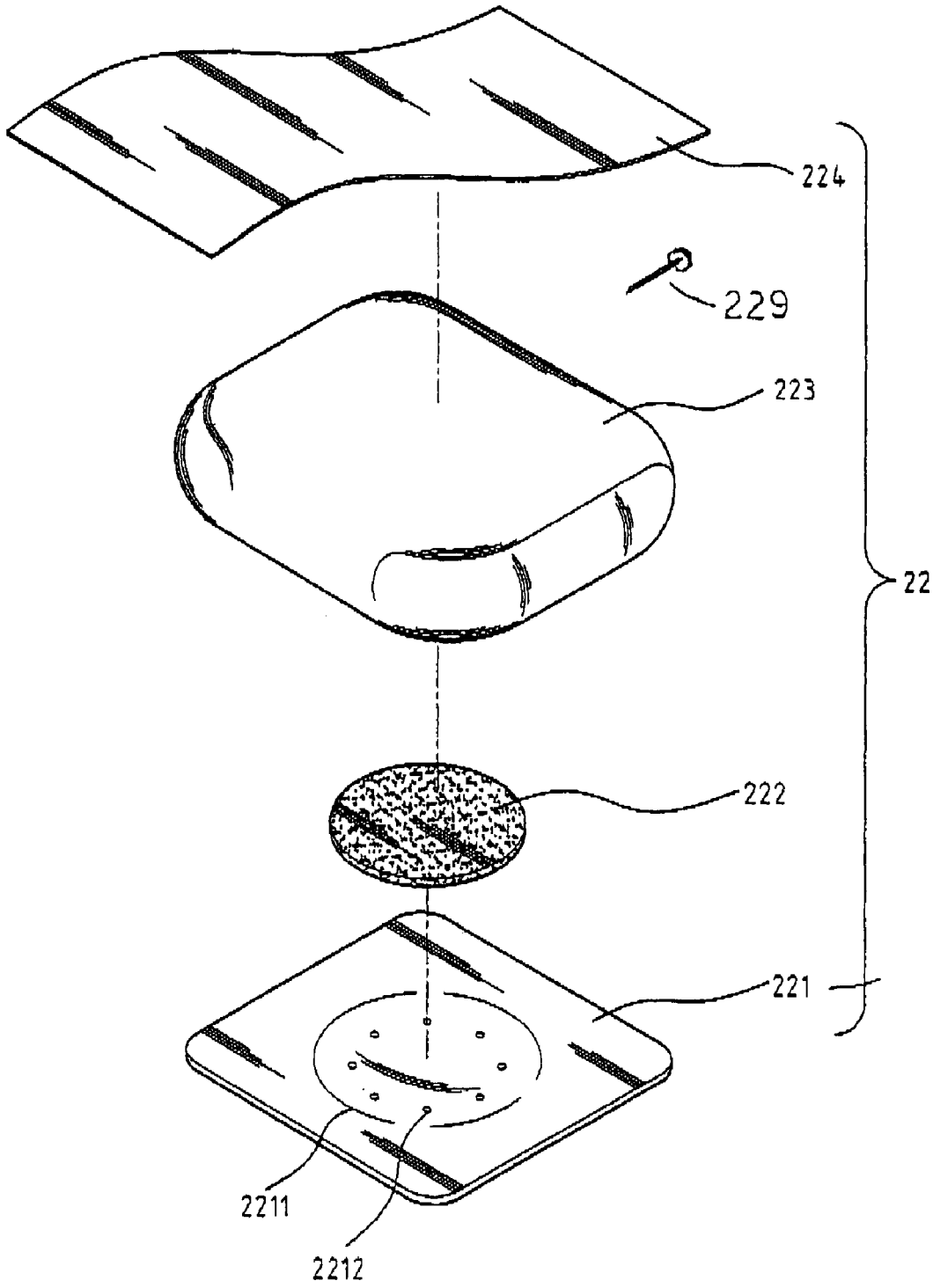
FIG. 2 is an exploded perspective view showing a cushion in accordance with the present invention.

With reference to FIG. 2, an exploded perspective view of the cushion 22 is shown. The cushion 22 includes a first hard board 221 made of an appropriate thickness of wood board. The center of the first hard board 221 is formed to a sunken concave surface 2211 for adapting to the curvature of the person buttocks. And a plurality of air vents 2212 are arranged in a ring manner on the sunken concave surface 2211. At the moment of a person sitting on the cushion 22, the air in the cushion 22 is discharged out by the air vent 2212. A sound absorbing foam 222, cut into a circular shape, is located on the sunken concave surface 2211, and is covering the air vents 2212, which then can reduce the gas releasing sound when the gas is given off from the air vents 2212. The spongy cushion 223, in an appropriate thickness, of which the sides are higher than the middle, is mounted on the sound absorbing foam 222. Finally, the spongy cushion 223, the sound absorbing foam 222, and the first hard board 221 are bundled and nailed together tightly and firmly by means of a big piece of soft leather 224. FIG. 2 shows a nail 229. But the piece of soft leather 224 would only be enough to wrap the aforementioned parts to the edge of the lower surface of the first hard board 221, which together with the piece of soft leather 224, is fixed by means of studs (not shown in the figures). Thus the air vents 2212 can be exposed. Finally, the finished cushion 22 is embedded at the inner side of the cushion frame 21.

Figure 3:
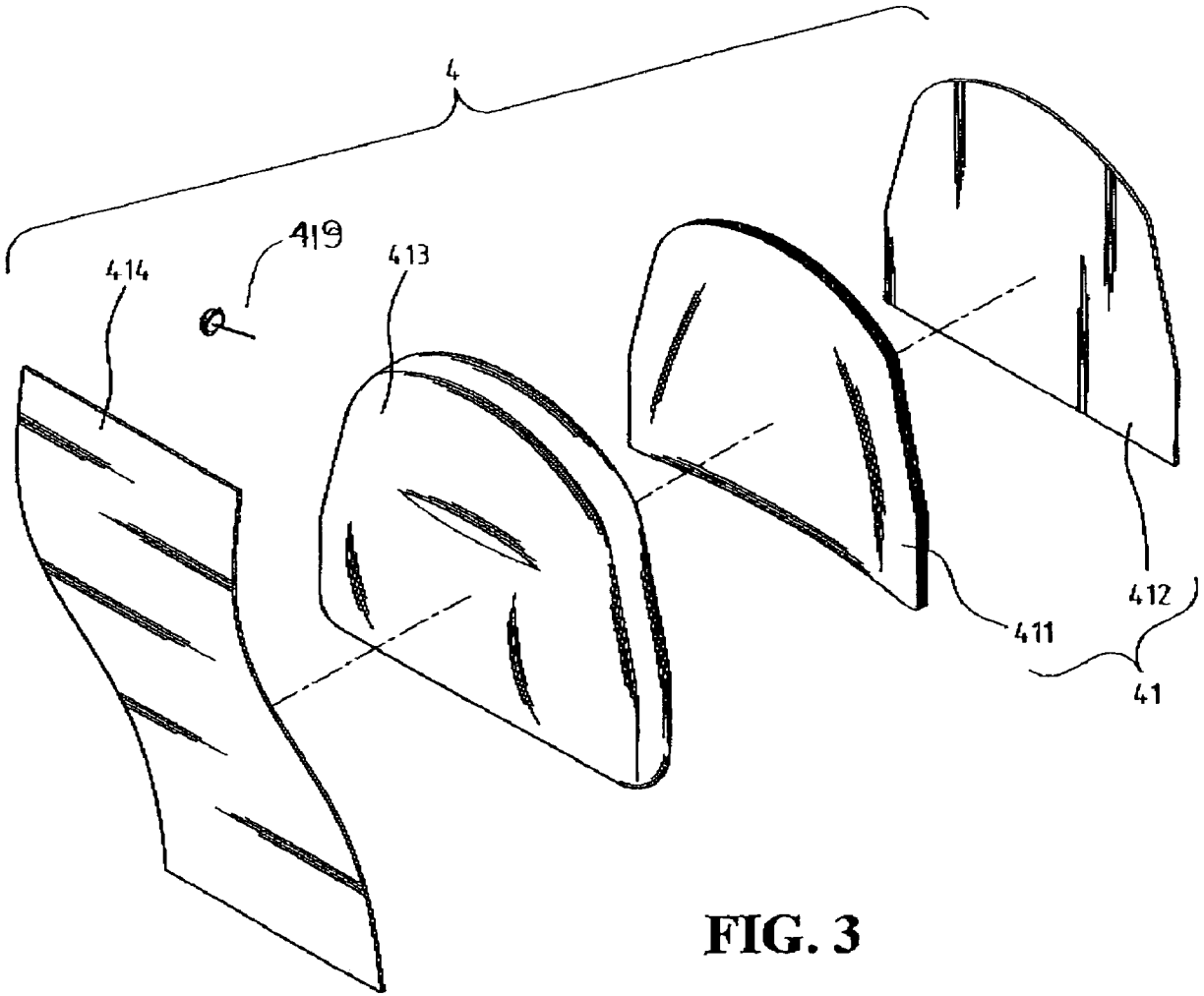
FIG. 3 is an exploded perspective view showing a back cushion in accordance with the present invention.

With reference to FIG. 1 and FIG. 3, the back cushion 4 includes a second hard board 41. The second hard board 41 includes an eight-layered plywood 411. Each of the layers in the plywood 411 is pressed to form the required sunken curved face by using a machine, respectively, and then they are all glued together. The sunken curved face in the middle of the upper surface of the plywood 411 is pressed to be adapted to the contour of a person back. A composite plywood board 412 having the same sunken concave face with the plywood 411 is nailed together with the last stacked layer of the plywood 411. FIG. 3 shows a nail 419. A thickness spongy cushion 413 of substantial thickness is glued with the surface of the plywood 411; therefore, a curved face whose two sides are higher than the middle portion is formed. In addition, the spongy cushion 413 and the second hard board 41 are wrapped with a big piece of the soft leather 414. The finished back cushion 4 is fixed on the inner edge in the arched section of the front leg 1 by using studs (not shown in figure). A plastic strip 5 is glued and attached in the grooves of the front leg 1 in order to improve the outer appearance.

Figure 4:
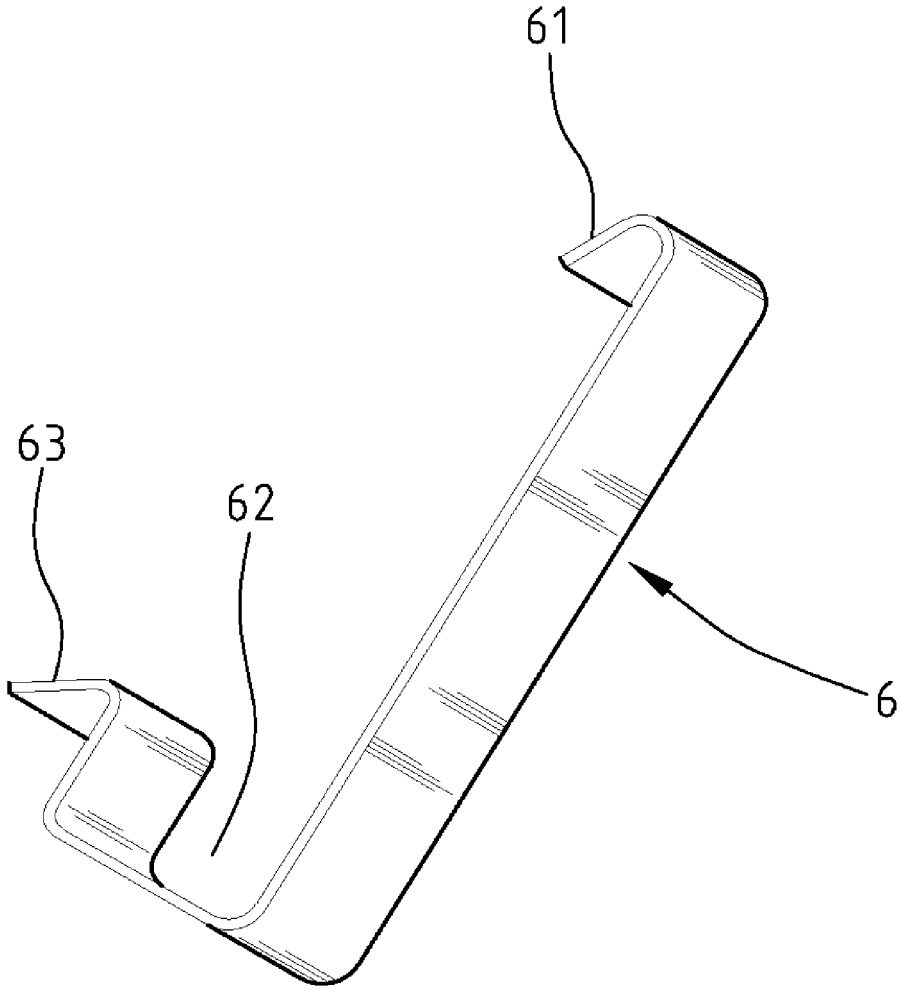
FIG. 4 is a schematic view showing a securing hook in accordance with the present invention.
Figure 5:
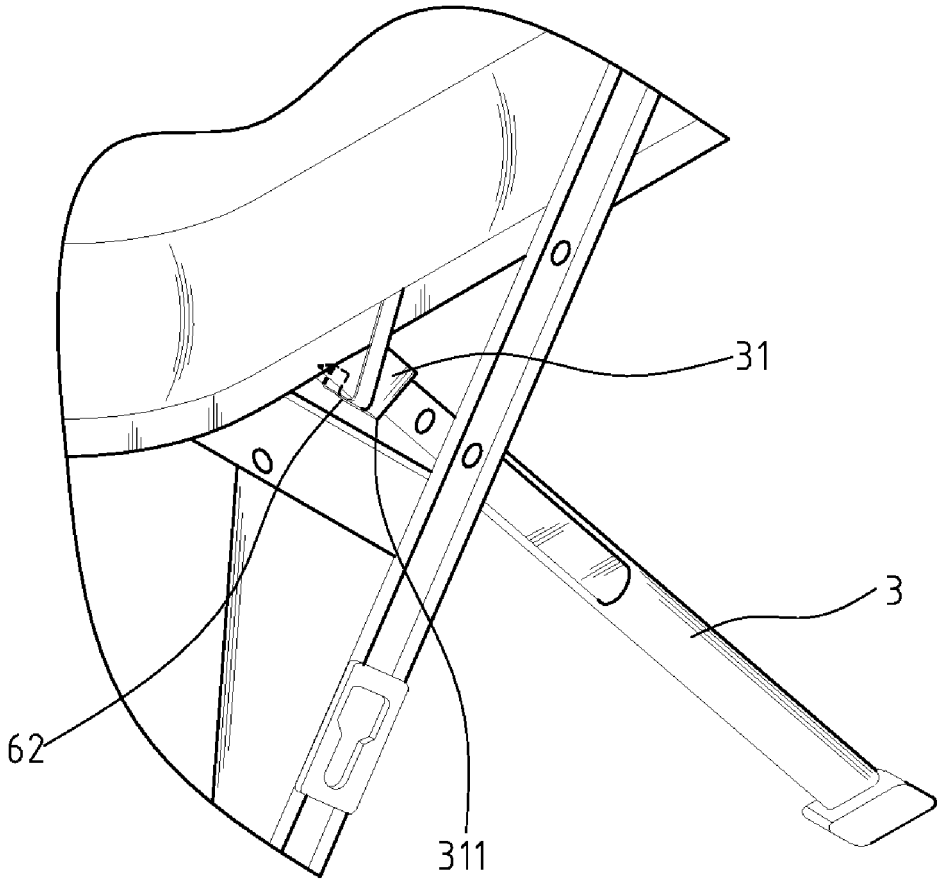
FIG. 5 is a schematic view showing the securing hook connected to the cushion frame and the back leg, respectively.

With reference to FIG. 4 and FIG. 5, one end of a securing hook 6 made from a iron sheet is bent to form a bent hook 61 and the other end is bent repeatedly to form a inserting section 62 having a space and a disengaging section 63. The support block 31 on the back leg 3 is formed with an oblique plane 311 in a given thickness and is facing to the front of the chair. In order to avoid the cushion section 2 from flipping or tilting over backwards when the child is sitting, the bent hook 61 of the securing hook 6 is clasped at a slant with the cushion frame 21 on one side of the chair. The oblique plane 311 of the support block 31 is pressed into the inserting section 62, and thus the cushion frame 21 and the back leg 3 is connected together.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A folding chair, comprising:

a front leg, in an arched shape;

a seat cushion section mounted on an inner side of the front leg and comprising a seat cushion frame and a seat cushion connecting to the seat cushion frame;

a back leg coupled to the inner side of the front leg;

a support block on an upper end of the back leg to support the seat cushion section;

a back cushion set on an arched section of the front leg, and a securing hook to allow the support block to be connected to the seat cushion section;

wherein the seat cushion comprises a first hard board including a plurality of air vents, a sound absorbing foam, and a spongy cushion, and the back cushion comprises a second hard board, a composite plywood board, and a spongy cushion, wherein both the first and second hard boards are made to be forming fitting with the contours of the human body;

wherein the spongy cushion covers substantially all of an upper surface of the first hard board; and wherein a center of the first hard board is formed to a sunken concave surface including the plurality of air vents, and the sound absorbing foam is located on the sunken concave surface and covers the air vents, and the spongy cushion is attached and fastened onto the sound absorbing foam and the first hard board.

2. The folding chair as claimed in claim 1, wherein the securing hook includes a flat iron sheet, and one end of the securing hook is bent to form a bent hook and the other end is bent repeatedly to form an inserting section and a disengaging section.

3. The folding chair as claimed in claim 2, wherein the bent hook is clasped to a side of the cushion frame, and the support block, with its entire thickness, is inserted into the inserting section.

4. The folding chair as claimed in claim 1, wherein the second hard board of the back cushion comprises a plurality of layers of plywood, and a middle section of a lower surface of the second hard board, the composite plywood board, and the spongy cushion are sunken and assembled to form a smooth curved surface between two ends thereof, and wherein the spongy cushion, the second hard board, and the composite plywood board are wrapped by soft covering material and are fastened together to form a back cushion to be form fitting according with the contours of a person's back so as to allow for leaning on.

5. The folding chair as claimed in claim 4, wherein the spongy cushion, the second hard board, and the composite plywood are nailed together.

6. The folding chair as claimed in claim 1, comprising a plastic strip glued and attached in a groove of the front leg.

7. A folding chair comprising:

a front leg, in an arched shape;

a seat cushion section mounted on an inner side of the front leg and comprising a seat cushion frame and a seat cushion connecting to the seat cushion frame;

a back leg coupled to the inner side of the front leg;

a support block on an upper end of the back leg to support the seat cushion section;

a back cushion set on an arched section of the front leg, and a securing hook to allow the support block to be connected to the seat cushion section;

wherein the seat cushion comprises a first hard board including a plurality of air vents, a sound absorbing foam, and a spongy cushion, and the back cushion comprises a second hard board, a composite plywood board, and a spongy cushion, wherein both the first and second hard boards are made to be forming fitting with the contours of the human body;

wherein the first hard board of the seat cushion includes a wood board, and a center thereof is formed to a sunken concave surface including the plurality of air vents, and the sound absorbing foam is located on the sunken concave surface and covers the air vents, and the spongy cushion is attached and fastened onto the sound absorbing foam and the first hard board, and soft covering material wraps the spongy cushion and is connected with the first hard board.

8. The folding chair as claimed in claim 7, wherein the spongy cushion is nailed onto the sound absorbing foam.

9. The folding chair as claimed in claim 7, wherein the soft covering material comprises leather.

* * * * *